US006649820B2

(12) United States Patent
Sassmannshausen

(10) Patent No.: US 6,649,820 B2
(45) Date of Patent: Nov. 18, 2003

(54) DOUBLE BASS-DRUM PEDAL

(75) Inventor: Werner Sassmannshausen, Bad Berleburg/Wingeshausen (DE)

(73) Assignee: Sonor Johs. Link GmbH, Bad Berleburg (DE)

( * ) Notice: Subject to any disclaimer, the term of this patent is extended or adjusted under 35 U.S.C. 154(b) by 0 days.

(21) Appl. No.: 10/085,628

(22) Filed: Feb. 28, 2002

(65) Prior Publication Data

US 2002/0121177 A1 Sep. 5, 2002

(30) Foreign Application Priority Data

Mar. 1, 2001 (DE) ..... 101 09 944

(51) Int. Cl.[7] ..... G10D 13/02
(52) U.S. Cl. ..... 84/422.1; 84/422.2; 84/422.3
(58) Field of Search ..... 84/422.1, 422.2, 84/422.3

(56) References Cited

U.S. PATENT DOCUMENTS 5,421,235 A 6/1995 Lombardi
6,239,342 B1 * 5/2001 Chang ..... 84/421
6,259,012 B1 * 7/2001 Hoshino ..... 84/422.1
6,271,450 B1 * 8/2001 Mackie ..... 84/422.1
6,281,418 B1 * 8/2001 Chang ..... 84/422.1

FOREIGN PATENT DOCUMENTS

DE 33 27 687 2/1985

* cited by examiner

*Primary Examiner*—Kimberly Lockett
(74) *Attorney, Agent, or Firm*—Herbert Dubno; Andrew Wilford

(57) ABSTRACT

A drum pedal assembly has a base plate adapted to sit on the floor and having an outer end adapted to be juxtaposed with a drum and an opposite inner end and a pedal pivoted on the base-plate inner end. A pair of posts having upper and lower ends are releasably fixed at the base-plate outer end with the posts generally parallel and vertical. Respective bearings on the post upper ends support a shaft carrying a beater mount. Mechanism links the pedal to the shaft for rotation of the shaft on depression of the pedal.

12 Claims, 4 Drawing Sheets

DOUBLE BASS-DRUM PEDAL

FIELD OF THE INVENTION

The present invention relates to a drum pedal. More particularly this invention concerns a double pedal for a bass drum.

BACKGROUND OF THE INVENTION

A standard drum pedal as described in German patent document 3,327,687 has a base plate that sits on the floor and that has an outer end normally cast unitarily with a pair of posts and adapted to be secured to the edge of the drum whose skin is oriented vertically in front of it. The posts carry bearings holding a horizontal shaft on which is mounted a beater mount, a sprocket wheel, and a spring crank. A pedal has an inner end pivoted on an inner end of the base plate and an outer end underneath the shaft and connected to the lower end of a chain looped over the sprocket and having an upper end fixed to the sprocket. The beater mount holds a shaft of a beater having a head engageable with the drum skin. The spring crank is connected offset from the shaft axis to the upper end of a tension spring whose lower end is anchored to the base plate so this spring urges the shaft into a position holding the beater head horizontally offset from the drum and holding the outer end of the pedal elevated. Thus when the pedal outer end is pressed down, the shaft is rotated to tension the spring and bring the beater head into engagement with the drum skin. When the pedal is released the spring retracts the beater head and raises the pedal.

Such a mechanism must be able to withstand substantial mechanical abuse. In its normal use it will be actuated thousands of times in a single session, often with considerable force. Hence the one-piece cast nature of the base plate and posts, typically of an aluminum alloy. As a result this part is quite expensive to manufacture and must be custom made, from its own die, for each different model of pedal.

U.S. Pat. No. 5,421,235 of Lombardi discloses a double bass-drum pedal. Here there are two separate pedal assemblies. The first one corresponds to that described above, minus the beater mount. The second one is substantially different, with one of the posts formed as a Y to provide a central pivot point for two separate but coaxial shafts, one of which carries a spring crank and beater mount as described above and the other of which only carries a beater mount. This other shaft is coupled via a connecting rod and two cardan joints to the shaft of the first pedal assembly. Thus two beaters can be set in the mounts of the second pedal assembly, one of which is actuated by the pedal of the first assembly and the other of which is actuated by the pedal of the second assembly. The heads of the beaters can be the same to allow for double-time bass-drumming, or they can be different to allow the drummer different sounds depending on which pedal he or she uses. The base plate and post structure for the second pedal assembly is quite complex and makes this piece of equipment very expensive.

OBJECTS OF THE INVENTION

It is therefore an object of the present invention to provide an improved drum pedal assembly.

Another object is the provision of such an improved drum pedal assembly which overcomes the above-given disadvantages, that is which can be adapted for use as a single or double drum pedal and that is simple to repair and/or modify in the field.

A further object is to design a pedal assembly whose parts are modular so that they can be used on different types of pedal assembly.

SUMMARY OF THE INVENTION

A drum pedal assembly has according to the invention a base plate adapted to sit on the floor and having an outer end adapted to be juxtaposed with a drum and an opposite inner end and a pedal pivoted on the base-plate inner end. A pair of posts having upper and lower ends are releasably fixed at the base-plate outer end with the posts generally parallel and vertical. Respective bearings on the post upper ends support a shaft carrying a beater mount. Mechanism links the pedal to the shaft for rotation of the shaft on depression of the pedal.

Thus according to the invention it is not necessary to provide a new complexly casted piece for each model of pedal. The base plate, for example, can be used for single- or double-pedal systems. In fact the same posts can be employed in both such systems. The result is a substantial saving in manufacturing costs. In addition this type of construction makes servicing of the pedal assembly, which as mentioned above takes a terrible beating in normal se, relatively easy. In fact the base plate can be formed with several sets of post sockets so that the system can be rebuilt in the field, and one casting is used for many different types of pedal assemblies.

According to the invention a support rod extends parallel to and below the shaft and has outer ends releasably fixed in the posts. A support block releasably fixed to the support rod between the posts holds a bearing supporting the shaft between the posts. For maximum rigidity of the support block the rod is of polygonal section and the posts have complementary seats for the rod outer ends.

More particularly in accordance with the invention the shaft has two coaxial and separate parts having outer ends journaled in the respective post upper ends and opposite inner ends. The inner end of one of the shaft parts is supported in the bearing of the support block. Another support block fixed to the support rod holds another bearing supporting the inner end of the other shaft part. One of the beater mounts is carried on one of the shaft parts, and another beater mount is carried on the other of the shaft parts. In this system the pedal has a pair of independently operable pedal parts and the mechanism includes a pair of independent linkages connecting the respective pedal parts to the respective shaft parts. One of the linkages includes a flexible element connecting the respective pedal part to the respective shaft part. The other of the linkages includes a push rod connecting the respective pedal part to the respective shaft part. The two pedal parts are pivoted together between opposite inner and outer ends of the pedal and are independently operable so that a user can operate one of the pedal parts with the toe of a foot and the other pedal part with the heel of the same foot. Such a system allows one foot to produce two distinct bass-drum effects, and the pedal assembly can be used on the right or left foot with no modification.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
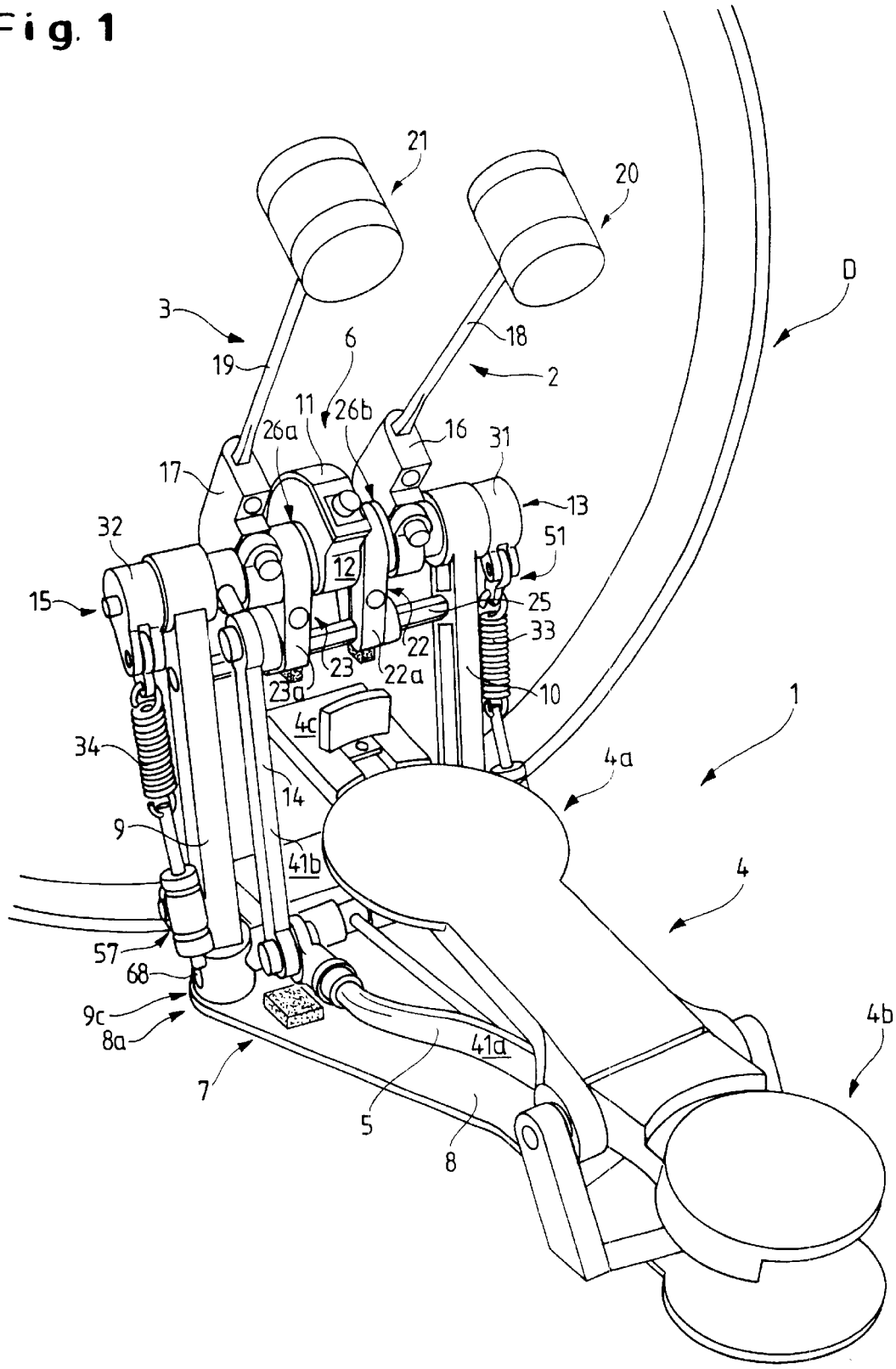
FIG. 1 is a perspective front view of a double bass-drum pedal according to the invention.
Figure 2:
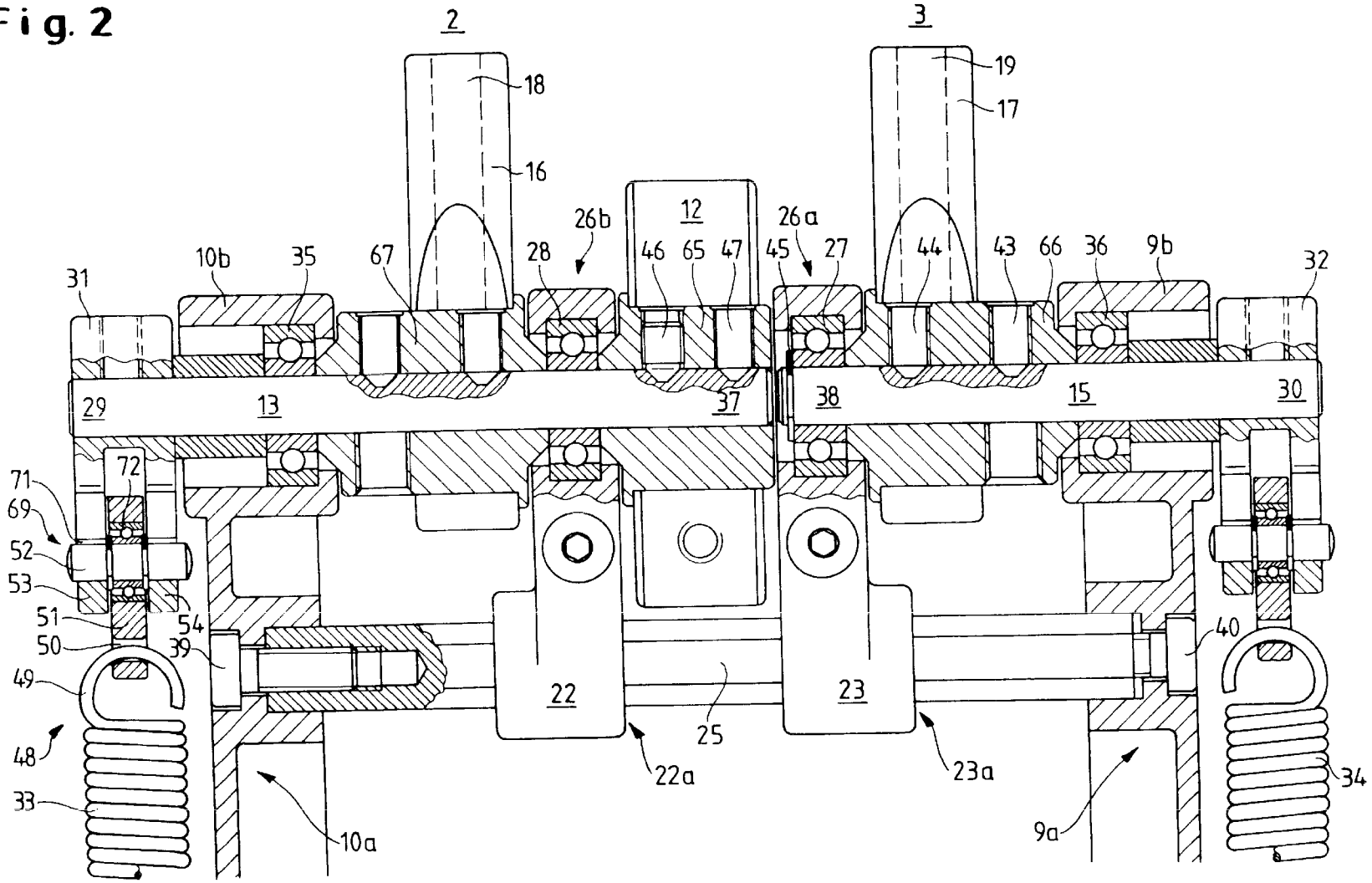
FIG. 2 is an upright large-scale section taken from the back of the pedal of FIG. 1.

As seen in FIG. 1 a pedal assembly 1 has a pair of beaters 2 and 3 connected by respective mechanisms 5 and 6 to respective parts 4*a* and 4*b* of a pedal 4. The pedal 4 is carried on a base 7 comprising a one-piece and normally horizontal cast plate 8 to whose outer end are bolted two vertical posts 9 and 10 having lower ends 9*c* and 10*c* secured by fasteners, here bolts 68, in an outer end 8*a* of the plate 8. The Posts 9 and 10 are identical, separate, and independent, that is they are separate pieces that are only connected together when bolted to the plate 8. The outer pedal part 4*a* has an outer extension 4*c* connected via a toothed plastic strap 11 to an eccentric or crank 12 secured as shown in FIG. 2 by a bushing 65 fixed by screws 46 and 47 to a right-hand shaft 13. The inner pedal part 4*b* is connected via a linkage 14 comprised of a rod 41*a* fixed on the part 4*b* and a push rod 41*b* itself connected to another bushing 66 fixed by screws 43 and 44 on another shaft 15 coaxial with the shaft 13. The bushing 66 also carries a mount 17 holding a shaft 19 of the beater 3 which has a head 21 engageable with a skin of a drum D that the outer end of the plate 8 is anchored to. The shaft 13 carries another bushing 67 similarly carrying a mount 16 for a shaft 18 of the beater 2 having a head 20.

Thus if the user presses down the inner pedal part 4*b* with his or her heel, the shaft 15 will be rotated to orbit the head 21 of the beater 3 against the drum D. Similarly, if the user presses down the outer pedal part 4*a* with his or her toe, the shaft 13 will be pivoted to orbit the head 20 of the beater 2 against the drum D.

Two cast-metal support blocks or bodies 22 and 23 have inner ends 22*a* and 23*a* fixed by unillustrated screws on a polygonal-section, here hexagonal-section support rod 25 itself fitted between middle parts 9*a* and 10*a* of the posts 9 and 10 and secured in place therein by bolts 39 and 40. Opposite ends 26*a* and 26*b* of the blocks 22 and 23 carry bearings 27 and 28 in which inner ends 37 and 38 of the respective rods 13 and 15 are seated. A snap ring 45 set in the inner end 38 of the rod 15 fixes it axially. Outer ends 29 and 30 of the rods 13 and 15 carry outside the respective posts 10 and 9 respective cranks or eccentric mounts 31 and 32 to which are hooked the upper ends of tension springs 33 and 34 whose lower ends are anchored to the plate 8. These springs 33 and 34 urge the rods 13 and 15 rotationally to pull the beater heads 20 ad 21 away from the drum D. These outer ends 29 and 30 are supported in roller bearings 35 and 36 in outer ends 10*b* and 9*b* of the posts 10 and 9. Thus each of the beater mounts 16 and 17 is mounted solidly between two bearings 27 and 36 or 28 and 35. Of course, if the system were to be used with only one beater, the blocks 22 and 23 could be eliminated and the respective shaft could extend all the way from the outer end 9*b* of the post 9 to the outer end 10*b* of the post lob, and of course other redundant structure could be eliminated. The rod 25 could be used as a stiffener or eliminated.

Figure 3:
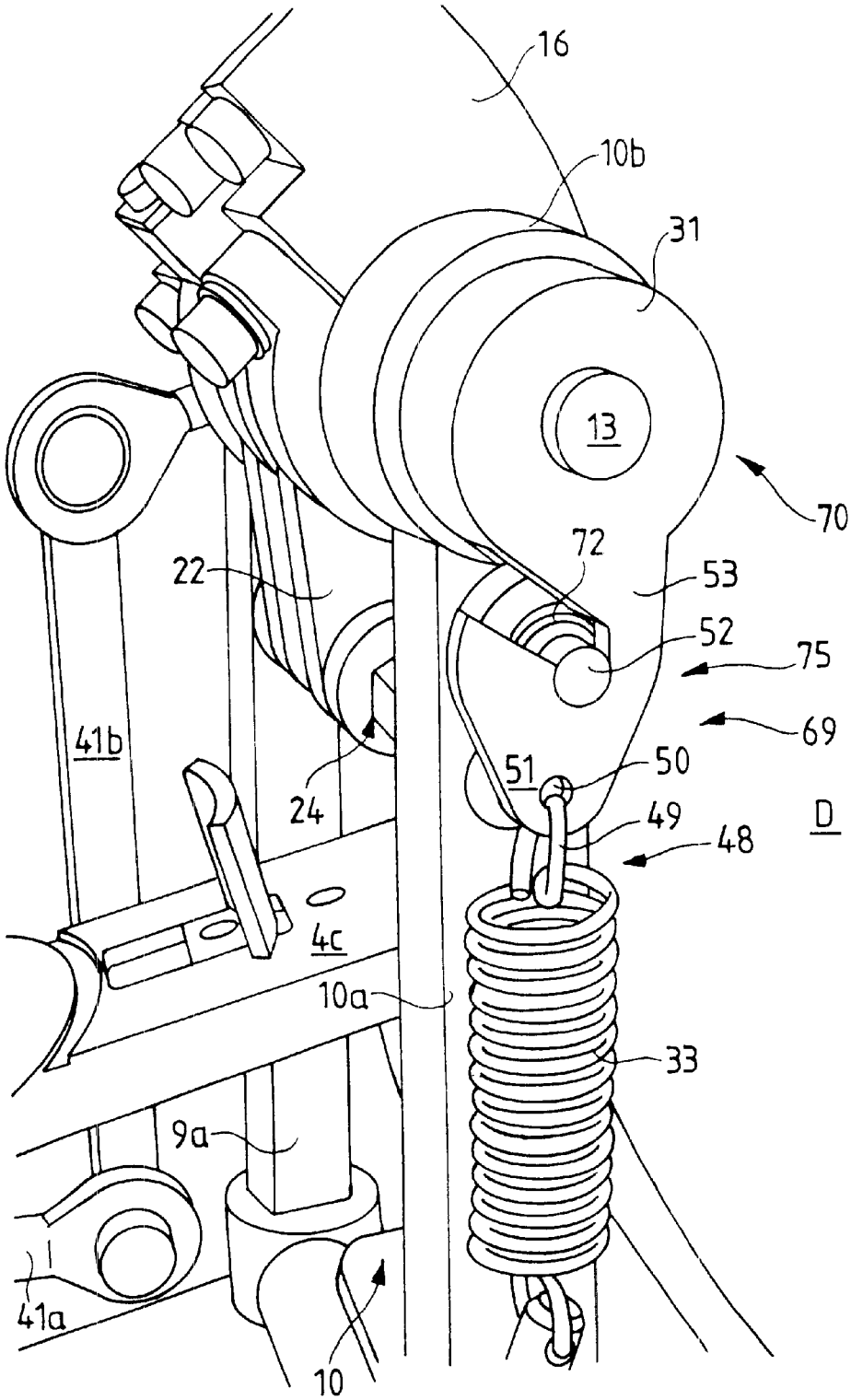
FIGS. 3 and 4 are large-scale perspective side views showing details of the invention.
Figure 4:
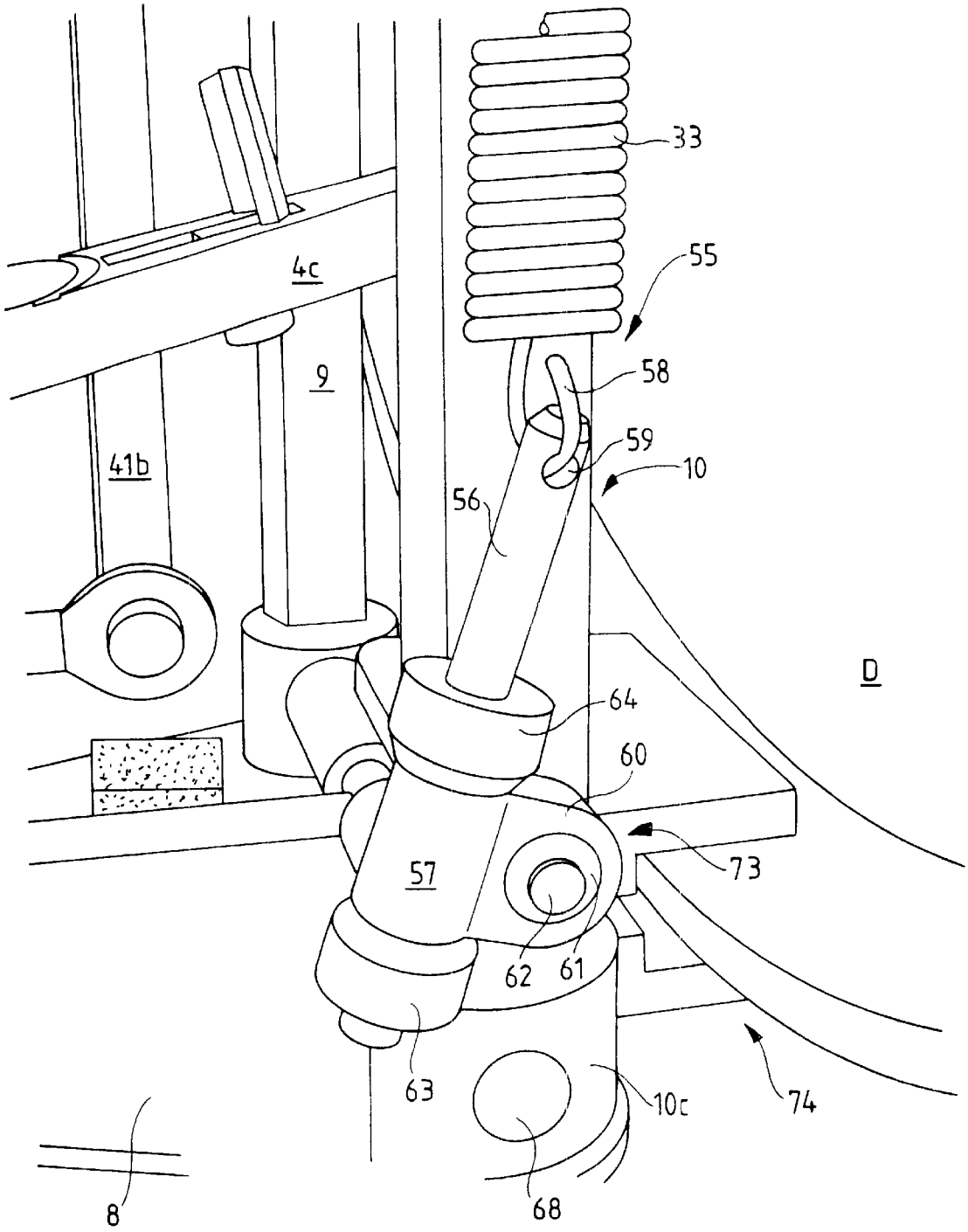

FIGS. 3 and 4 show the connection system for the spring 33 which is identical to that for the spring 34. The spring 33 has a upper end 48 formed with a hook 49 engaged through a hole 50 in an eye plate 51 having a bearing 71 carrying a pin 52 engaged in a pair of hooks 53 and 54 formed on the crank 31. Thus the upper spring end 48 can easily be hooked on the crank 31 or unhooked.

The lower end 55 of the spring 33 shown in FIG. 4 is connected to an adjustment device 73 secured to a lower end 10*c* of the post 10. The device 73 comprises a threaded rod 56 passing through a support eye 57 having a lug 60 pivotal on a bearing 61 on a shaft 62 fixed in the lower rod end 10*c*. The spring 33 has a ring 58 on its lower end 55 passing through a hole 59 in the upper end of the rod 56. Two nuts 63 and 64 flanking the eye 57 can be used to vary the tension in the spring 33.

I claim:

1. A drum pedal assembly comprising:

a base plate adapted to sit on the floor and having an outer end adapted to be juxtaposed with a drum and an opposite inner end;

a pedal pivoted on the base-plate inner end;

a pair of separate and independent posts having upper and lower ends;

means including respective fasteners engaged between the post lower ends and the base plate for releasably fixing the post lower ends at the base-plate outer end with the posts generally parallel and vertical;

respective bearings on the post upper ends;

a shaft journaled in the bearings;

a beater mount carried on the shaft; and mechanism linking the pedal to the shaft for rotation of the shaft on depression of the pedal.

2. The drum pedal assembly defined in claim 1, further comprising:

a support rod extending parallel to and below the shaft and having outer ends seated in the posts;

means releasably fixing the support-rod outer ends in the posts; and a support block releasably fixed to the support rod between the posts; and a bearing on the support block supporting the shaft between the posts.

3. The drum pedal assembly defined in claim 2 wherein the rod is of polygonal section and the posts have complementary seats for the rod outer ends.

4. The drum pedal assembly defined in claim 1, further comprising spring means rotationally biasing the shaft.

5. A drum pedal assembly comprising:

a base plate adapted to sit on the floor and having an outer end adapted to be juxtaposed with a drum and an opposite inner end;

a pedal pivoted on the base-plate inner end and having a pair of independently operable pedal parts;

a pair of posts having upper and lower ends;

means for releasably fixing the post lower ends at the base-plate outer end with the posts generally parallel and vertical;

respective bearings on the post upper ends;

a support rod extending parallel to and below the shaft and having outer ends seated in the posts;

means releasably fixing the support-rod outer ends in the posts;

a pair of support blocks on the support rod between the posts;

a shaft having a pair of coaxial shaft parts having outer ends journaled in the bearings and axially juxtaposed inner ends journaled in the support blocks;

respective beater mounts carried on the shaft parts; and mechanism including a pair of independent linkages linking the pedal to the respective shaft parts for rotation of the shaft parts on depression of the respective pedal parts.

6. A drum pedal assembly comprising:

a base plate adapted to sit on the floor and having an outer end adapted to be juxtaposed with a drum and an opposite inner end;

a pedal pivoted on the base-plate inner end;

a pair of posts having upper and lower ends;

means for releasably fixing the post lower ends at the base-plate outer end with the posts generally parallel and vertical;

respective bearings on the post upper ends;

coaxial and separate shafts having outer ends journaled in the respective bearings and axially juxtaposed opposite inner ends;

respective beater mounts carried on the shafts;

mechanism linking the pedal to the shafts for rotation of the shafts on depression of the pedal;

a support rod extending parallel to and below the shafts and having outer ends seated in the posts;

means releasably fixing the support-rod outer ends in the posts;

respective support blocks releasably fixed to the support rod between the posts; and respective bearings on the support blocks supporting the shafts between the posts.

7. The drum pedal assembly defined in claim 6 wherein the pedal has a pair of independently operable pedal parts and the mechanism includes a pair of independent linkages connecting the respective pedal parts to the respective shafts.

8. The drum pedal assembly defined in claim 6 wherein one of the linkages includes a flexible element connecting the respective pedal part to the respective shaft.

9. The drum pedal assembly defined in claim 8 wherein the other of the linkages includes a push rod connecting the respective pedal part to the respective shaft.

10. The drum pedal assembly defined in claim 7 wherein the two pedal parts are pivoted together between opposite inner and outer ends of the pedal and are independently operable, whereby a user can operate one of the pedal parts with the toe of a foot and the other pedal part with the heel of the same foot.

11. The drum pedal assembly defined in claim 1 wherein the fasteners are bolts at the post lower ends.

12. The drum pedal assembly defined in claim 1 wherein the posts are substantially identical.

* * * * *